US009061800B2

(12) United States Patent
Jons

(10) Patent No.: US 9,061,800 B2
(45) Date of Patent: Jun. 23, 2015

(54) BAG FOR STORAGE AND REMOVAL OF OXYGEN

(71) Applicant: Carolyn Kay Jons, Eden Prairie, MN (US)

(72) Inventor: Carolyn Kay Jons, Eden Prairie, MN (US)

( * ) Notice: Subject to any disclaimer, the term of this patent is extended or adjusted under 35 U.S.C. 154(b) by 8 days.

(21) Appl. No.: 13/829,649

(22) Filed: Mar. 14, 2013

(65) Prior Publication Data

US 2014/0270581 A1 Sep. 18, 2014

(51) Int. Cl.

| | |
|---|---|
| ***B29D 22/00*** | (2006.01) |
| ***B65D 33/25*** | (2006.01) |
| ***B65B 7/06*** | (2006.01) |

(52) U.S. Cl.
CPC .. *B65D 33/25* (2013.01); *B65B 7/06* (2013.01)

(58) Field of Classification Search
CPC ..... B65B 7/06; B65D 33/25; B65D 81/266; B65D 75/38
USPC ..... 428/35.2; 383/62; 426/106, 133
See application file for complete search history.

(56) References Cited

U.S. PATENT DOCUMENTS

| | | | | | |
|---|---|---|---|---|---|
| 4,125,791 | A * | 11/1978 | Futterer | 310/154.09 |
| 4,332,845 | A * | 6/1982 | Nawata et al. | 206/204 |
| 4,378,076 | A * | 3/1983 | Stirnweiss | 222/146.5 |
| 5,458,848 | A * | 10/1995 | Burgaud | 422/5 |
| 5,908,234 | A * | 6/1999 | Kreeft | 362/223 |
| 6,007,529 | A * | 12/1999 | Gustafsson et al. | 604/410 |
| 6,399,387 | B1 * | 6/2002 | Stenholm et al. | 436/1 |
| 6,596,191 | B2 * | 7/2003 | Sakamoto et al. | 252/188.28 |
| 6,680,113 | B1 * | 1/2004 | Lucast et al. | 428/354 |
| 7,868,779 | B2 * | 1/2011 | Ginggen et al. | 340/10.34 |
| 8,017,033 | B2 * | 9/2011 | Sugimoto et al. | 252/188.28 |
| 8,221,647 | B2 * | 7/2012 | McKedy | 252/188.28 |
| 2008/0070307 | A1 * | 3/2008 | Kodama | 436/2 |
| 2008/0292225 | A1 * | 11/2008 | Dayrit et al. | 383/207 |
| 2008/0292821 | A1 * | 11/2008 | Dayrit et al. | 428/34.9 |
| 2009/0116768 | A1 * | 5/2009 | Huerta et al. | 383/207 |
| 2010/0005973 | A1 * | 1/2010 | Doglioni Majer | 99/295 |
| 2013/0272630 | A1 * | 10/2013 | Thomas et al. | 383/201 |

* cited by examiner

*Primary Examiner* — James Yager

(57) ABSTRACT

A flexible bag for food storage includes an oxygen remover, a water impermeable membrane, a frangible seal, and walls having low oxygen transmission. The wall comprises two facing sheets, and at least one sheet is a multilayer sheet having an inner layer of polymer enabling the facing sheets to be joined by melt sealing at less than 95° C. The bag may be sealed at location other than the frangible seal. A machine-readable image (e.g. QR code) may direct a computer or phone to a video on the Internet that shows re-sealing the bag at a location separate from the frangible seal to isolate the storage region from air surrounding the bag.

13 Claims, 3 Drawing Sheets

BAG FOR STORAGE AND REMOVAL OF OXYGEN

FIELD OF INVENTION

The present invention generally relates to a flexible bag suitable for oxygen absorption and food storage, as well as a package containing a plurality of bags and a sealing device. The invention further relates to their use.

BACKGROUND OF INVENTION

In both Unites States and the United Kingdom, separate studies have indicated that about a third of all food purchased is wasted. At the household level, the largest contributor (>20%) to this food waste is fruits and vegetables. The most common reason given for this disposal was that the fruits and vegetables were moldy or slimy. This invention is aimed at improving the situation by enabling an improved food storage method.

Both inside and outside refrigerators, flexible storage bags are commonly used by consumers to store food. Plastic bags are available to the public in many stores and are most usually sold by the box. A variety of designs for sealable plastic bags have been contemplated, but the most common seals are interlocking slide devices (e.g. U.S. Pat. Nos. 2,558,367; 4,186,786). In 1957, a $5^{th}$ grader name Robert Lejeune won a National Science Fair competition by demonstrating that sealable pouches, similar to Ziploc™ bags and sold as pencil cases at the time, retarded food spoilage in some cases. This present invention also results from a Science Fair project, this time demonstrating a new bag design that prevents mold growth.

With food and many other items negatively impacted by storage in oxygen, prolonged useful life would be possible if the presence of air were avoided. For this purpose, vacuum storage bags (e.g. U.S. Pat. Nos. 6,883,665, 7,290,660) and associated equipment for sealing these bags are sold. However, commercial devices for vacuum sealing in the home are fairly expensive and take up space. Further, residual air remaining in bags can negatively impact storage results. Also, the vacuum associated with remaining spaces between food provides a driving force to encourage air to enter through small leaks. Finally, vacuum storage is less desirable for food that is readily deformable under pressure. For example, raspberries may become in large part juice due to pressure exerted upon them.

Another approach to prolong food storage is removal of just oxygen. For this purpose, commercial oxygen absorption packets (e.g. U.S. Pat. No. 4,332,845) have been available for years. However, it seems that adoption of this technology has been limited by several factors. First, oxygen absorption packets are not typically sold in stores where food is present. For this purpose, convenient packaging with a long shelf life is needed. Related to this, oxygen absorption packets would need to be packaged in small numbers, as the common practice of including 20-50 in a common oxygen-isolating package requires consumers to either use all at once or undertake inconvenient steps to store the remainder. Further, an oxygen-impermeable container of appropriate size is necessary. Finally, significant adoption will require the product to be both easy to use and easy to understand.

To address these issues, a new, easy-to-use, flexible bag design has been created that contains an oxygen removing material. It is hoped that this invention can provide consumers with a more convenient method to prevent mold growth and keep food fresh longer.

SUMMARY OF INVENTION

A flexible bag for food storage has walls formed of two facing sheets that are joined together along three adjacent edges to form a rectangular pouch. Each of the facing sheets has an oxygen transmission rate at 25° C. of less than 10 $cm^3/m^2$/day. At least one of the facing sheets is a multilayer sheet having an inner layer of polymer enabling the facing sheets to be joined by melt sealing at less than 95° C.

A frangible seal affixes the two facing sheets within the pouch and separates the pouch into inner and outer sections. The inner section contains an oxygen remover, an optional oxygen indicator, a storage region with fillable volume between 0.35 L and 8.5 L, and a water impermeable membrane. The water impermeable membrane has an oxygen transmission rate of more than 2000 $cm^3/m^2$/day at 25° C. and separates the oxygen remover from the storage region.

The bag may also include another sealing mechanism different from the frangible seal to isolate the storage region from air surrounding the bag. An adhesive seal is preferred, and one embodiment is a foldable tab with adhesive. A process for sealing flexible bags containing an oxygen remover is also described that includes submerging a sealing device in hot water, removing the sealing device from water, and pressing the warmed sealing device against the bag to join facing sheets. The invention also includes a package comprising a plurality of bags and a sealing device appropriate for this purpose. In another embodiment, a wall of the bag includes a machine-readable image, directing a computer or phone to a video on the Internet that shows both opening the frangible seal and re-sealing the bag at a separate location to isolate the storage region from air surrounding the bag.

BRIEF DESCRIPTION OF DRAWINGS

The invention and its various embodiments may be better understood by reference to the detailed description and accompanying figures. Within these sections, like reference numerals refer to like elements.

DETAILED DESCRIPTION

Mold can't grow without the presence of oxygen. For this reason the flexible bag of this invention includes an oxygen remover. As described in different references (e.g. U.S. Pat. Nos. 4,524,015; 5,028,578; 5,143,763; 8,221,647; US 2007/0212461A1; US 2012/0128532A1) a large variety of oxygen removing materials are known. In a preferred embodiment, the oxygen remover includes a high surface area iron powder that can react in air to remove oxygen (e.g. $2Fe_2+3O_2 \rightarrow 2Fe_2O_3$). The remover preferably includes iron particles of less than 100 microns average size. The oxygen remover may also include other materials, such as silica gel or clay for water storage, activated carbon for odor reduction, and sodium chloride or acid for increasing the oxidation rate of iron.

The flexible bag of this invention is preferably sufficient to store between than 0.4 L and 8 L of oxygen-sensitive material (e.g. perishable food), roughly corresponding to sizes between common sandwich bags and two gallons. However, the invention could be used with smaller and larger volumes as well. Preferably, the oxygen remover is of sufficient capacity to remove oxygen from the largest fillable volume of the bag, allow for a 10 minute (or even 30 minute) exposure during loading, and account for leakage through side walls and seals over a year's time. The oxygen remover is preferably sized to lose more than 25%, or even 50%, of its capacity if it were stored for five years. Similarly, the oxygen remover is preferably sized to lose 25%, or even 50%, of its capacity if it were exposed for two hours of loading time.

Figure 1:
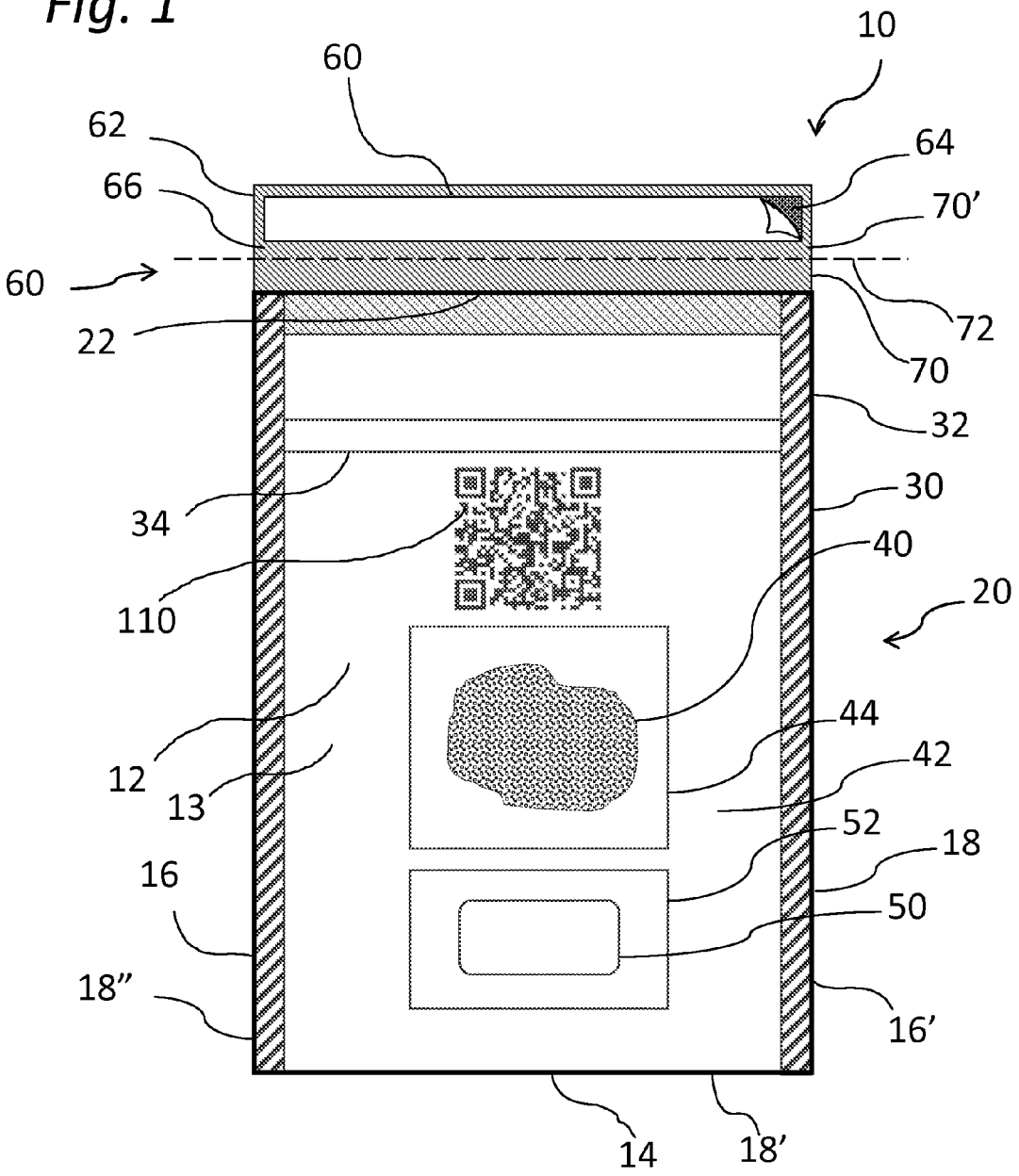
FIG. 1 is a drawing of one embodiment of the flexible bag.

An embodiment of the flexible bag of this invention is illustrated in FIG. 1. The bag 10 is made from two facing, flexible sheets 12 that form the walls 13 of the bag. The two facing sheets are joined together (e.g. by a fold 14, an adhesive, or melt seal 16), along three adjacent edges 18 to form a rectangular pouch 20 with opening 22 at the top. These facing sheets have an oxygen transmission rate at 25° C. of less than 10 $cm^3/m^2$/day, more preferably less than 5 $cm^3/m^2$/day, or even less than 2 $cm^3/m^2$/day. The oxygen transmission rate depends on both material type and thickness, so many available sheets have this property. However, preferred polymeric materials that contribute to low oxygen permeability include ethylene vinyl alcohol copolymer (EVOH), polyacrylonitrile (PAN), polyvinyl acetate (PVA), and Saran™. Composites sheets can also incorporate a metal or metal oxide layer that inhibits oxygen permeability.

At least one, and preferably both, of the facing sheets 12 is a multilayer sheet. The inner layer facilitates heat sealing and joining to another facing sheet. The inner layer includes a polymer with relatively low melting point compared to other layers of the facing sheets, enabling the two facing sheets to be joined during manufacture or later by an end-user. A preferred multilayer sheet has an inner layer of lower temperature polymer enabling the consumer to join facing sheets by melt sealing at a temperature of less than 95° C. Preferably, the consumer could use less than 100 psi, 60 psi, or even 20 psi to seal the bag. (Preferably, the multilayer sheets can be sealed at a temperature between 50° C. and 95° C., but they do not enable melt sealing by the consumer below 50° C.) The multilayer sheet also includes other layers contributing more to strength and/or low oxygen permeability. In a preferred embodiment, both facing sheets include a coating or intermediate layer that is a metal or metal oxide layer.

The two facing sheets 12 may be of any thickness. A conventional plastic bag (e.g. Ziploc™ sandwich bag) has polyethylene thickness of about 2 mil (0.05 mm). However, for sealing and handling a bag containing a weighty oxygen removing component, the inventor has found that the preferred sheet thickness is greater than 3 mil (>0.076 mm).

The pouch 20 is separated into inner 30 and outer 32 sections by a frangible seal 34 affixing the two facing sheets. A "frangible" seal means one that it is breakable during opening. The inner section 30 of the pouch contains both an oxygen remover 40 and a storage region 42 with a fillable volume between 0.35 L and 8.5 L. A water impermeable membrane 44 with high oxygen permeability separates the oxygen remover 40 from materials in the storage region 42. As used herein, "water impermeable" refers to the fact that liquid water does not pass at a pressure differential of 1 bar. The membrane preferably has an oxygen transmission rate of more than 2000 $cm^3/m^2$/day, more preferably more than 10,000 $cm^3/m^2$/day, at 25° C. Polymers with relatively high oxygen permeability coefficients include poly(propylene), low density poly(ethylene), Teflon, natural rubber and silicone rubber, but a variety of materials may be used depending on thickness. Additionally, the water impermeable membrane 44 may have small pores and be hydrophobic or oleophobic, so that liquid does not pass through at low (<1 bar) pressure. More preferably, the impermeable membrane 44 may be a non-porous film with high gas permeation, as described for instance in U.S. Pat. No. 6,680,113 or as used in the 3M Tegaderm product. BASF's Styrolux®(styrene-butadiene copolymer) is another film with high oxygen permeability.

The frangible seal 34 initially isolates the oxygen remover 40 and storage region 42 within the pouch from air outside the pouch. The initially closed frangible seal is integral with the bag, by which it means that the seal is not optionally added or made closed. Rather, the closed seal is manufactured into the bag. Because this integral closed seal is formed at approximately the same time as seals along edges 18 of the bag 10, the capacity of the incorporated oxygen remover 40 is kept high. In the intended use, this integral, frangible seal 34 ensures long shelf-life (e.g. in the store) for the oxygen remover 40 prior to breaking the seal by the consumer. The frangible seal must be opened to allow food or other items to be placed within the storage region of the bag. After the initial integral closed frangible seal 34 of this invention is opened, it is not re-sealable to equivalent performance by the consumer.

There are many ways to create a frangible seal. Illustrative of one preferred seal type is a common potato chip bag, which includes a frangible seal that is opened by the consumer. These seals are often made by a process of optimally applying heat and pressure to a polymer for a specific amount of time. Increasing any of the three factors (heat, pressure, time) may lead to greater strength. In this embodiment, the seal type is not re-sealable by the consumer. One advantage of this type of frangible seal is that it is less likely to contact food in an intimate and undesired manner. Alternatively, other preferred frangible seals within scope of this invention can retain some ability to re-join the two facing sheet surfaces after opening, but the seal is no longer able to prevent oxygen passage to the same degree as the initial integral closed seal. Although this embodiment has increased oxygen passage after seal breakage, retaining some of the ability to join two facing surfaces can assist in positioning the two facing sheets to allow making other seals between them (to be described later) more facile.

In addition to the type of seal, oxygen transmission through the integral frangible seal 34 can depend on the seal's dimensions (e.g. length, thickness, and width). Preferably, the frangible seal allows oxygen passage of less than 0.5 $cm^3$/day, more preferably less than 0.1 $cm^3$/day, so that capacity of the oxygen remover is not overly degraded within a year's storage time. The bag's frangible seal preferably opens with a force of less than 20 N.

In addition to the oxygen remover 40, storage region 42, and impermeable membrane 44, the inner section 30 of the pouch 20 may contain an oxygen indicator 50. For example, the presence of oxygen may be indicated by a chemical reaction, such as using the chemistry described in patent application US 2008/10070307A1. However, in this bag 10, it desirable that chemicals within the oxygen indicator 50 be isolated from the storage region by an isolating membrane 52 which may be the same as the aforementioned water impermeable membrane 44. Preferably, passage of gas between an oxygen indicator 50 and the bag's oxygen remover 40 requires passage through at least two water impermeable membranes 44,52. The isolating membrane 52 separating the indicator 50 from the storage region 42 preferably has a transmission rate of at least 2000 $c^3/m^2$/day, or more preferably at least 10000 $c^3/m^2$/day. This membrane preferably has greater oxygen transmission than the water impermeable membrane separating the oxygen remover from the storage region.

The invention preferably includes a consumer implementable sealing mechanism 60, different from the frangible seal 34, that is capable of isolating the storage region 42 from air outside the bag 10. In the intended use, this consumer sealing mechanism 60 is closed by the consumer following the placement of food or other items within the storage region of the bag. This sealing mechanism 60 is capable of being sealed at a temperature of less than 25° C. So that open time for the bag is minimized, operation of this consumer implementable sealing mechanism 60 is quick and requires no additional tools. To maximize space available for food storage and assist in opening the frangible seal 34, the consumer sealing mechanism 60 is preferably located within the outer section 32 of the pouch 20, as defined by the frangible seal 34. In this case, the sealing mechanism 60 is capable of isolating the storage region and at least a part of the outer section 42 from air surrounding the bag 10.

Figure 2:
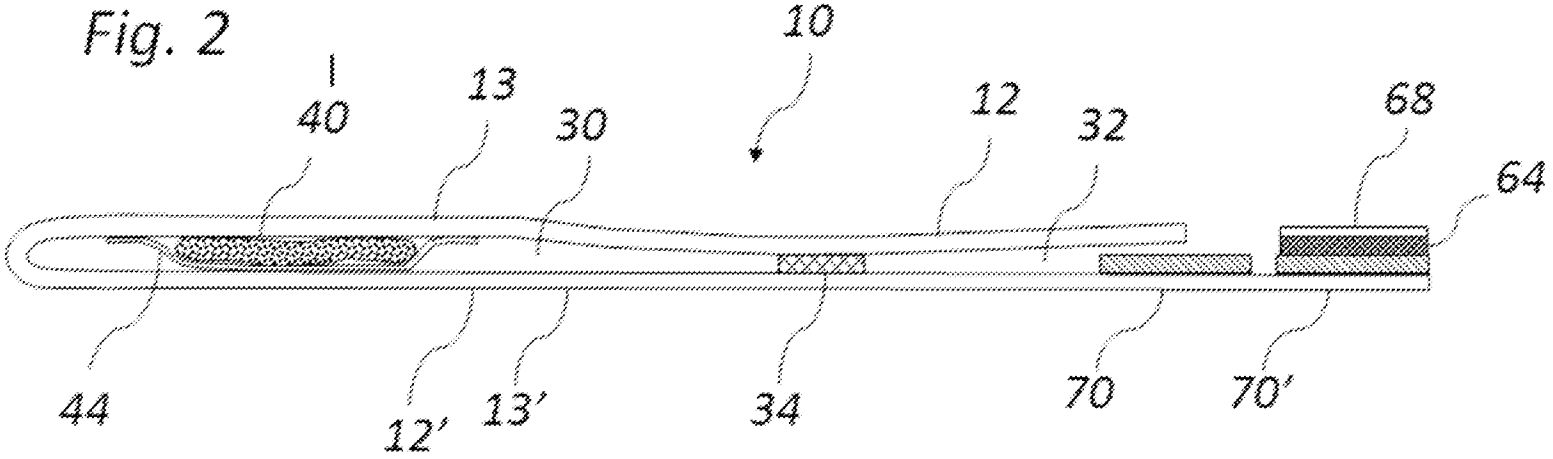
FIG. 2 is a cross section of a flexible bag embodiment with a frangible seal.
Figure 3:
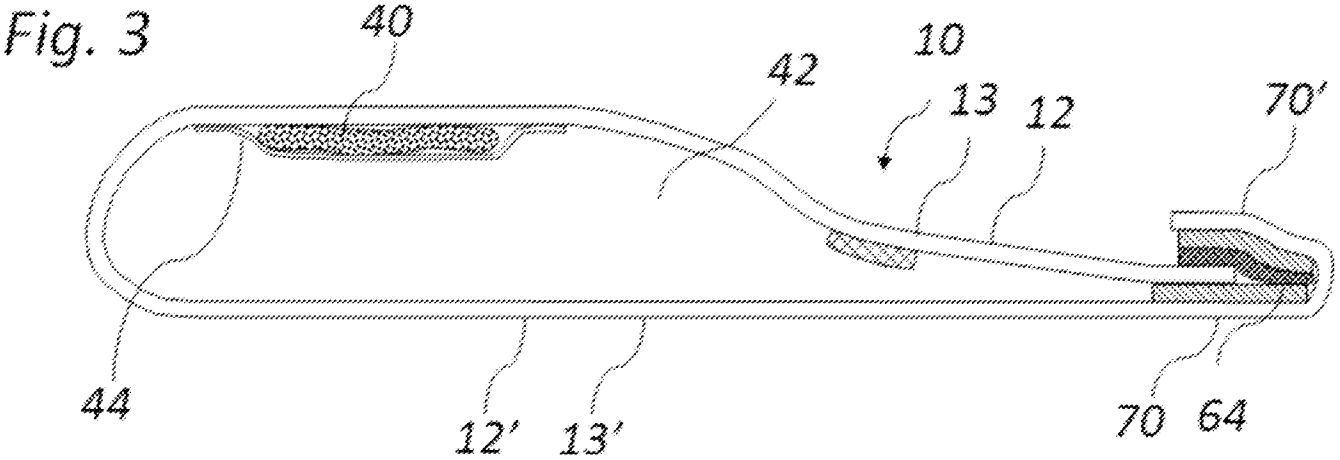
FIG. 3 is a cross section of a flexible bag embodiment after the frangible seal has been opened and the consumer implementable sealing mechanism has been sealed.
Figure 4:
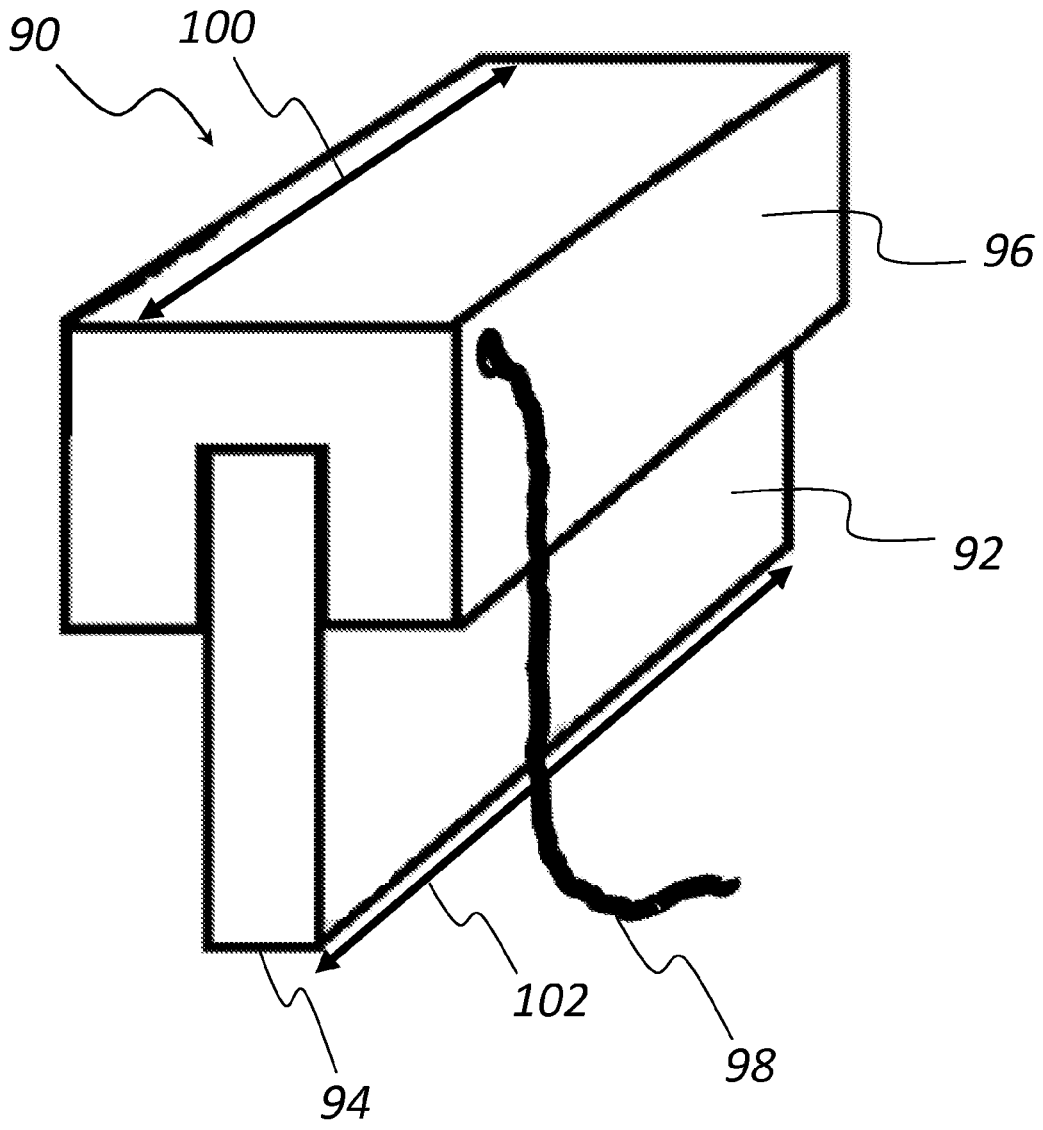
FIG. 4 is a perspective drawing of a heat sealing device.

The consumer implementable sealing mechanism 60 can take many forms. In preferred configurations, the sealing mechanism includes an adhesive (e.g. U.S. Pat. No. 7,290,660; US 2008/0044144A1) that limits air passage. FIG. 2 illustrates an embodiment that includes a folded tab 62 coated with adhesive 64 on one surface 66. FIG. 3 illustrates the same bag after breaking the frangible seal 34 and closing the consumer implementable sealing mechanism 60 with the foldable tab 62 having adhesive 64. To improve its effectiveness, the adhesive coated surface is preferably affixed to a removable protective layer 68. To avoid wrinkles during sealing, the inventor has found it advantageous that the foldable tab 62 comprises a rigid region 70 with greater stiffness than the average stiffness of the walls 13 of the bag. In one embodiment, rigid regions 70,70' of greater stiffness are on both sides of a fold line 72. The stiffness (force/deformation) for a foldable tab region may be more than twice or more than four times that for one of the sheets making up a wall 13. Improved sealing without wrinkles may further be achieved by constructing the bag with an increased thickness or mass per unit area in the region of a foldable seal.

Another aspect of this invention is a process for sealing flexible bags 10 containing an oxygen remover 40 that includes submerging a sealing device 90 in hot water, removing the sealing device 90 from water, and pressing the warmed sealing device 90 against the bag 10 to join facing sheets 12,12'. For this purpose, it is preferred that the sealing device 90 contains a metal bar 92. It is also preferred that the storage bag has walls 13 with oxygen transmission rate at 25° C. of less than 10 $cm^3/m^2$/day, more preferably less than 5 $cm^3/m^2$/day, or even less than 2 $cm^3/m^2$/day. At least one of the walls 13 comprises a multilayer sheet 12 having an inner layer of polymer enabling the facing sheets of the bag to be joined by melt sealing at less than 95° C.

Currently, vacuum sealers are commonly used to join facing sheets of heat-meltable bags by heat sealing. A typical vacuum sealer marketed for household use (Food Saver© V2222) comprises a 30 cm long sealing section heated by electricity. Another similar unit for this purpose is the Frigidaire Vacuum Sealer© (Model # 5304454102). The actual temperature attained by heating elements for these vacuum sealers has not been determined by the inventor, but it has been found by the inventor that bags sold with these vacuum sealer do not seal by pressing of a metal bar heated in boiling water. Similarly, a collection of other bags sold for food storage were similarly found to not seal using a metal bar heated in boiling water. The inventor has found that layers of 3M Scotchpac™ HB-P 69731 Translucent High Barrier Film are able to be joined and sealed by this method. The film product contains a ceramic metal oxide coating that inhibit oxygen passage and a 0.5 mil ethylene vinyl acetate (EVA) copolymer later on one surface to enable sealing.

The inventor has identified several properties of a preferred sealing device. The sealing device includes an elongated bar 92 with a continuous sealing section 94 that extends tangent to a plane over a length between 5 and 25 cm. In use, this flat, continuous sealing section 94 contacts the plastic film and creates a continuous seal between two adjacent sheets 12. The elongated bar has high (>5, or even >20 W/(m K)) thermal conductivity. The volumetric heat capacity of the bar is preferably greater than 2 J/($cm^3$ K). The mass of the elongated bar is preferably at least 0.5 g per cm of length. In this way, stored thermal energy within the bar 92 can be a source for heat during multiple sealing operations. Another component of the sealing device is made of a material (e.g. wood, plastic) with much lower (<1 W/(m K) thermal conductivity. This lower thermal conductivity component 96 may be positioned at the ends or be located across one side of the elongated bar 92, so that the bar can be more readily held and the continuous sealing section 94 can be pressed at elevated temperature against the bag 10 by the consumer. In one embodiment, the bar also includes a flexible piece 98 (e.g. string, thread, cord) that can extend several centimeters (>5 cm) from one end of the sealing device, allowing the consumer to more easily remove the device from the hot water, while not extending the overall length of the sealing device in storage.

The length of the sealing device is important. If the sealing device 90 has a flexible piece 98 or adjustable piece, the sealing device 90 may have a minimum length 100 different from the maximum length. So as to minimize storage space when not in use, preferred embodiments of a sealing device have a minimum length 100 of the sealing device 90 that is not more than 20% greater, more preferably not more than 10% greater, than the length 102 of the continuous sealing section 94 of a metal bar 92 that contacts the plastic sheet. Although many seal lengths required for bags will be greater than 25 cm, some preferred embodiments will have a length 102 of the continuous sealing section 94 of a metal bar 92 that is less than 15 cm. In this way, the metal bar can be more easily submerged in water using standard microwavable mugs or cups, in the way many modern consumers are accustomed to heating water. In one embodiment, the length 102 of the continuous sealing section 94 of a metal bar 92 is between 7 and 15 cm in length, more preferably between 8 and 13 cm.

Bags for food storage are typically sold by the box, with a large number of bags within each box. Another aspect of this invention is a package (e.g. box or bag) that comprises at least four, or even at least ten, storage bags 10 and a sealing device 90 as described above. Appropriate storage bags are made of flexible sheets 12 with low oxygen transmission rate (less than 10 $cm^3/m^2$/day, 5 $cm^3/m^2$/day, or even less than 2 $cm^3/m^2$/day), and at least one of the facing sheets is a multilayer sheet having an inner layer of polymer enabling the facing sheets to be joined by melt sealing at less than 95° C. Preferably, the minimal length 100 of the sealing device 90 is less than the largest diagonal of the bag. More preferably, the sealing device is not longer than longest edge dimension of the bag. Most preferably, the length 102 of the continuous sealing section 94 of a metal bar is greater than half the width of the bag opening. In this way, a bag may be sealed by two successive heat sealing operations.

From the perspective of the average consumer, a bag containing an oxygen remover would be new and potentially confusing. Use of the bag may involve different and unfamiliar ways to open the bag, load material within the storage region, or seal the oxygen remover and contents within the bag. Consequently, in another embodiment, at least one of the walls 13 of a flexible bag for food storage includes on it a machine-readable image 110 directing a computer or phone to a video on the Internet that shows how to open or seal the bag. The video may show opening a frangible seal 34 or closing the bag 10 using any of the procedures previously mentioned. Both opening and closing actions may be shown in the video.

The image 110 is preferably a multi-dimensional visual code that is machine-readable. Most preferably, the image is a QR code (abbreviated from Quick Response Code), a type of matrix barcode. QR codes descriptions and different uses for these are include in patent applications US 2006/0082475A1, US 2011/0085732A1, US 2012/0280031A1, US 2012/0291647A1, US 2013/0035787A1, and US 2013/0036162A1. Alternatively, other multi-dimensional visual codes include Codablock, Ezcode, DataGlyphs, MixiCode, ShotCode, and Aztec Code. Preferably, the image 110 directs a device with appropriate hardware and software to a video that demonstrates use of the bag 10. This may be done by embedding within the machine-readable visual code a direct link to the video or to a URL containing a link to the video. Appropriate devices (e.g. smart phones and computer systems) are becoming common, and include a camera, display means, and Internet connection. Examples of appropriate software include NeoReader, BeeTagg, RedLaser, QuickMark, i-nigma, and Kayawa Reader.

For best results, using the inventive bag to prevent oxygen passage may be an exacting process, such that it may be more effective to show than describe. In one embodiment, the video may show the steps of re-sealing the bag with a consumer implementable sealing mechanism 60 that isolates the storage region 42 and at least a part of the outer section 32 from air surrounding the bag 10. For instance, in the case of the folded tab 62 consumer seal in FIGS. 2 and 3, the video may show sealing the bag by removal of the protective layer 68 to expose adhesive 64 on a surface 66, and then folding a section of the tab 62 over one of the two facing sheets 12. The video may further show how to avoid wrinkles (such as by sealing from the center to the periphery). In the case of forming a seal by a low temperature melt process, the video may show heating water in a cup, placing a sealing device 90 in the water to warm a metal bar 92, removing the sealing device 90 by handling it by a component 96 of material having low thermal conductivity, and applying pressure to the warm bar 92 and at least one multilayer sheet 12, such that facing sheets are joined together.

It is preferred that a plurality of bags (at least four bags, preferably at least 10, or even at least 100 bags) are sold in a package (e.g. a box or bag), and each bag may also include on its wall 13 an individual identifier. In one embodiment, a machine readable image 110 is different for each bag 10 within a package. In this way, software loaded on a phone or computer (including those computers within cameras, refrigerators, or other devices made capable of reading the image) may record and make retrievable information assigned to individual bags and/or their contents. The same image or a different machine readable image on the bag may also link to a video, as described above.

Examples below are intended to be instructive but not to limit the scope of this invention. The entire subject matter of each of the previously cited references is incorporated herein by reference.

EXAMPLES

Example 1

One embodiment of the flexible bag may be created as follows. The walls of the bag are made from a 15 cm (6 inch) wide by 60 cm (24 inch) long sheet of Scotchpac™ HB-P 69731 Translucent High Barrier Film. 3M has published that this material is a multilayer laminate of 0.08 mm (3.1 mil) polyester (PET) with a 0.01 mm (0.5 mil) heat sealable ethylene vinyl acetate (EVA) copolymer inner layer. According to the 3M product page, a ceramic oxide coating ($AlO_x$) results in an oxygen transmittance by ASTM D 3985 of 1.3 $cm^3/m^2/day$.

Several items are affixed to the inner layer of the multilayer sheet as follows: A piece of opaque paper (e.g. 8 cm×8 cm) is adhered to the inner surface of the multilayer sheet, approximately 15 cm from the top edge. The paper contains written instructions and a QR code that links to a video. An iron powder mixture extracted from an AGELESS® (ZPT 500) absorption packet is spread on top of the paper. A 10"×10 cm strip of 3M Tegaderm membrane with adhesive backing is used to hold the iron powder in place against the opaque paper and multilayer sheet. In preparation for forming the frangible seal, an adhesive layer is applied in a line across the sheet width to the inner surface (EVA) of the multilayer sheet at a location approximately 5 cm from the top edge. The consumer implementable seal is created by adhering two aligned pieces of a relatively rigid clear plastic near the top edge of the multilayer sheet, and then applying a backed adhesive to the top most piece.

The long multilayer sheet is folded over itself to result in two facing multilayer sheets, with the EVA copolymer layers facing inward. The location of the fold is selected to cause the adhesive section of the resulting foldable tab to partially overlap both facing sheets. The adhesive layer applied in a line at 5 cm from the top edge is put under pressure to join and seal both sheets, forming the frangible seal. Using a Food Saver© V2222 vacuum sealer (without vacuum), facing sheets are thermally sealed together along their outer long edges (including over the line of applied adhesive). Through these side seals and the frangible seal, the oxygen remover is isolated from air surrounding the bag.

While this description provides a workable bag, one skilled in the art will recognize that many variations are possible and are within the scope of this invention.

Example 2

An experiment compared five bags having approximately the construction described above to five commercial freezer zippered bags having similar volume. An Ageless© oxygen removal packet was placed in commercial bags and the constructed bags of this invention were made with the iron-based, oxygen removing mixture from identical packets. Sheets of 3M Petrifilm were inoculated with a uniform solution containing mold spores taken from blueberries, placed in petri dishes to create a repeatable volume of "empty" air, and sealed inside the constructed and commercial bags. After one week, the samples sealed inside of the commercial freezer bag had a large (and undetermined) number of mold colonies, whereas no mold colonies were observed on 3M Petrifilm within the constructed bags.

Example 3

Bags were constructed as above, except that the inoculated Petrifilm container was built into the bag's storage region. In this way, the integrity of the frangible seal could be tested. This experiment relates to the shelf life one might expect for a product. While tests will need to be done in the future for longer times, after the last observation at 115 days, no mold growth was observed in samples.

Example 4

Bags were constructed as above. Strawberries and cheese were placed in these bags and in commercial zippered bags of the same size. Strawberries stored in commercial bags showed evidence of significant mold growth after four days. Cheese stored in commercial bags showed significant mold after six days. After twice as long, in each case, no mold was observed for food in the constructed bag. The experiment was terminated at that point, as the appearance of food items within the constructed bags had began to lessened due to other aspects (weeping for un-refrigerated cheese and moisture-loss for strawberries).

The invention claimed is:

1. A flexible bag for food storage comprises two facing sheets forming the walls of a bag, each of the facing sheets having an oxygen transmission rate at 25° C. of less than 10 $cm^3/m^2$/day, and at least one of the facing sheets is a multi-layer sheet having an inner layer of polymer enabling the facing sheets to be joined by melt sealing at less than 95° C.; wherein the two facing sheets are joined together along three adjacent edges to form a rectangular pouch, and the pouch is separated into inner and outer sections by a frangible seal affixing the two facing sheets; the inner section contains an oxygen remover, an oxygen indicator, a storage region with fillable volume between 0.35 L and 8.5 L, and a water impermeable membrane with oxygen transmission rate at 25° C. of more than 2000 $cm^3/m^2$/day separates the oxygen remover from the storage region wherein a first membrane retards oxygen passage between the oxygen remover and the storage region, a second membrane retards oxygen passage between the oxygen indicator and the storage region, and the oxygen permeability of the first membrane is less than the oxygen permeability of the second membrane.

2. The flexible bag for food storage of claim 1, wherein the pouch further includes a consumer implementable sealing mechanism that is capable of isolating the storage region from air surrounding the bag; the consumer implementable sealing mechanism is capable of being sealed without tools at a temperature of less than 25° C.

3. The flexible bag for food storage of claim 2, wherein the consumer implementable sealing mechanism is located within the outer section of the pouch.

4. The flexible bag for food storage of claim 2, wherein the consumer implementable sealing mechanism comprises an adhesive sealant.

5. The flexible bag for food storage of claim 3, wherein the consumer implementable sealing mechanism comprises a foldable tab coated with adhesive on one surface.

6. The flexible bag for food storage of claim 5, wherein the adhesive coated surface is affixed to a removable protective layer.

7. The flexible bag for food storage of claim 5 wherein the foldable tab comprises a rigid region with stiffness more than twice the average stiffness of the walls of the bag.

8. The flexible bag for food storage of claim 1 wherein at least one of the walls contains a machine-readable image that is a multi-dimensional visual code suitable to direct a computer or phone having camera, display, internet connection, and appropriate software to read the image to a video on the Internet that shows both opening the frangible seal and re-sealing the bag at a separate location to isolate the storage region from air surrounding the bag.

9. The flexible bag for food storage of claim 8, wherein the image is a QR code.

10. The flexible bag for food storage of claim 8, wherein the video on the internet further shows the bag being re-sealed using a consumer implementable sealing mechanism that comprises a foldable tab.

11. The flexible bag for food storage of claim 8, wherein the video on the internet further shows the bag being re-sealed using a sealing device comprising an elongated metal bar that has been heated in water to a temperature of between 50° C. and 100° C.

12. A method of sealing the flexible bag of claim 1 comprising the steps of 1) placing a sealing device comprising an elongated bar with thermal conductivity greater than 5 W/(m K) into water, 2) warming the bar to a temperature of between 50° C. and 100° C., 3) removing the warmed bar from the water, and 4) pressing the bar against a wall of the bag to join facing sheets by melt sealing and to isolate the storage region from air surrounding the bag.

13. The method of claim 12 wherein the sealing device comprises an elongated metal bar with a continuous sealing section that extends tangent to a plane over a length between 5 and 25 cm and an insulating component affixed to the metal bar that facilitates handling of the metal bar when hot, wherein the insulating component is made of material having a thermal conductivity of less than 1 W/(m K).

* * * * *